US007093557B2

(12) United States Patent
Caruso

(10) Patent No.: US 7,093,557 B2
(45) Date of Patent: Aug. 22, 2006

(54) FASTENER COVER

(76) Inventor: Robert Caruso, 209 Fifth Range Rd., Pembroke, NH (US) 03275

( * ) Notice: Subject to any disclaimer, the term of this patent is extended or adjusted under 35 U.S.C. 154(b) by 76 days.

(21) Appl. No.: 10/911,445

(22) Filed: Aug. 4, 2004

(65) Prior Publication Data

US 2006/0027157 A1 Feb. 9, 2006

(51) Int. Cl.
*B63B 17/02* (2006.01)

(52) U.S. Cl. ..... 114/361; 52/107

(58) Field of Classification Search ..... 114/361, 114/363, 364; 52/177
See application file for complete search history.

(56) References Cited

U.S. PATENT DOCUMENTS 5,070,664 A 12/1991 Groh et al. ..... 52/177
5,113,781 A 5/1992 Link ..... 114/361
5,302,001 A * 4/1994 van Dis ..... 297/228.13
5,327,844 A 7/1994 Kress ..... 114/218
5,396,861 A 3/1995 Acker et al. ..... 114/361
5,904,011 A 5/1999 Biro ..... 52/177
6,595,155 B1 7/2003 Akers ..... 114/361

* cited by examiner

*Primary Examiner*—Jesus D. Sotelo
(74) *Attorney, Agent, or Firm*—Peter A. Nieves; Sheehan Phinney Bass & Green, PA

(57) ABSTRACT

A fastener cover capable of covering exposed studs on a boat contains a padded portion having a top surface and a bottom surface and at least one socket sized to couple to an exposed stud. The socket is located on the bottom surface of the padded portion, so that when the fastener cover is attached to the exposed stud, the stud is covered by the padded portion.

1 Claim, 9 Drawing Sheets

FASTENER COVER

FIELD OF THE INVENTION

The present invention is generally related to covers, and more particularly is related to a fastener cover.

BACKGROUND OF THE INVENTION

When a boat 100 is not in use, boat covers 102 are often used to protect passenger areas of the boat from exposure to the elements, as shown in FIG. 1A. The boat covers 102 generally attach to a perimeter of the hull 104 and provide a barrier between the interior of the hull 104 and the outside environment. During use of the boat 100, the boat cover 102 is removed and stored for later use as shown in FIG. 1B. After use of the boat 100, the boat cover 102 is put back in place.

The boat cover 102 couples to the hull 104 of the boat 100 with fasteners 106, typically around the perimeter of the hull 104 or regions covered by the boat cover 102 (i.e., the bow or stern portion). A variety of fasteners 106 can be used to attach the boat cover 102 to the hull 104 of the boat 100. One example is a snap fastener 200 as shown in FIG. 2. The snap fastener 200 allows the user to easily snap or unsnap the boat cover 102 to the hull 104 of the boat 100. The snap fastener 200 has a stud 202 coupled to the hull 104 by a screw, rivet, or bolt. A socket 204 is coupled to the boat cover 102 by a cap 206. Of course, the socket 204 and cap 206 may be one piece. The socket 204 fits over the stud 202 and is pressed down onto the stud 202. The snap fastener 200 provides a friction fit that holds the socket 204 to the stud 202.

Another example of a fastener 106 used to couple a boat cover 102 to the hull 104 of the boat 100 is an eyelet fastener 300. FIG. 3A is an elevation view and FIG. 3B is a top view of the eyelet fastener 300. The eyelet fastener 300 has a stud 302 with a head 304 that is broader than the body 306 of the stud 302. The boat cover 102 has several eyelets 308 around the perimeter of the boat cover 102. Each eyelet 308 has an eyelet opening 310 that is sized to be specially positioned in order to fit over the head 304 of the stud 302. When the eyelet 308 is positioned over the head 304 of the stud 302 and on the body 306 of the stud 302, the eyelet 308 is secured to the stud 302 and prevented from slipping over the broader head 304 of the stud 302.

The fasteners 106 used to couple the boat cover 102 to the hull 104 are not limited to the two examples discussed above. A variety of other types of fasteners 106 can be used. However, the fasteners 106 used to couple boat covers 102 to their respective hulls 104 often leave the stud 202, 302 of the fastener 106 exposed when the boat cover 102 is not in place. This can produce a hazard to individuals on or near the boat. Accidental contact with the studs 202, 302 can cause abrasions, cuts, and bruises. Additionally, clothing and inflatable water toys can be ripped or punctured by the studs 202, 302.

Thus, a heretofore unaddressed need exists in the industry to address the aforementioned deficiencies and inadequacies.

SUMMARY OF THE INVENTION

In one aspect, the invention features a fastener cover used to cover exposed studs on a boat, thereby protecting individuals near or on the boat from any potential injury that may be caused by brushing against an exposed stud. The fastener cover contains a padded portion having a top surface and a bottom surface and at least one socket sized to couple to an exposed stud, where the socket is located on the bottom surface of the padded portion, so that when the fastener cover is attached to the exposed stud, the stud is covered by the padded portion.

Other features and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1A:
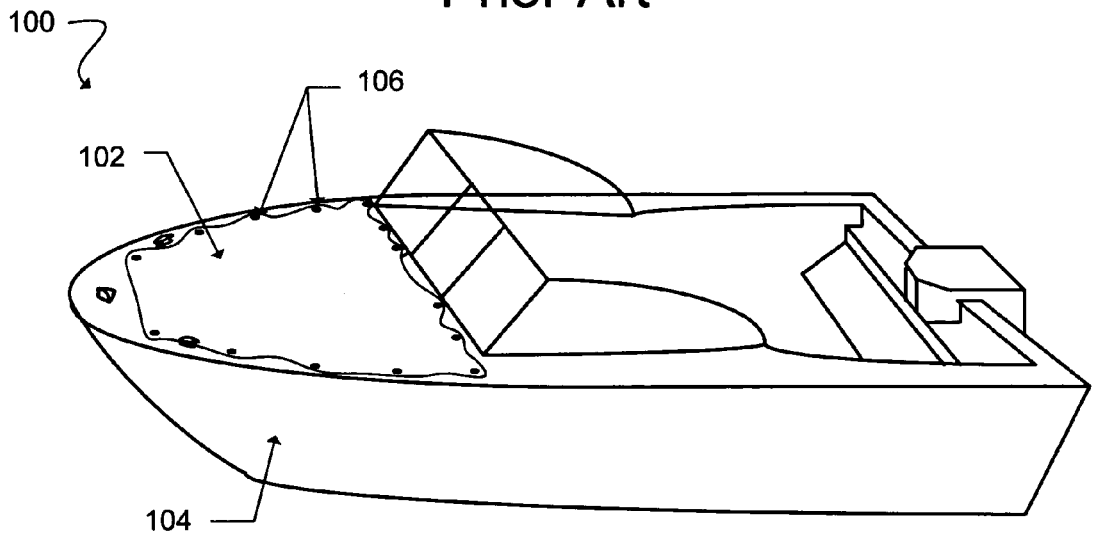
FIG. 1A Prior Art
FIG. 1A is a perspective view of a boat with a boat cover on the bow of the boat.
Figure 1B:
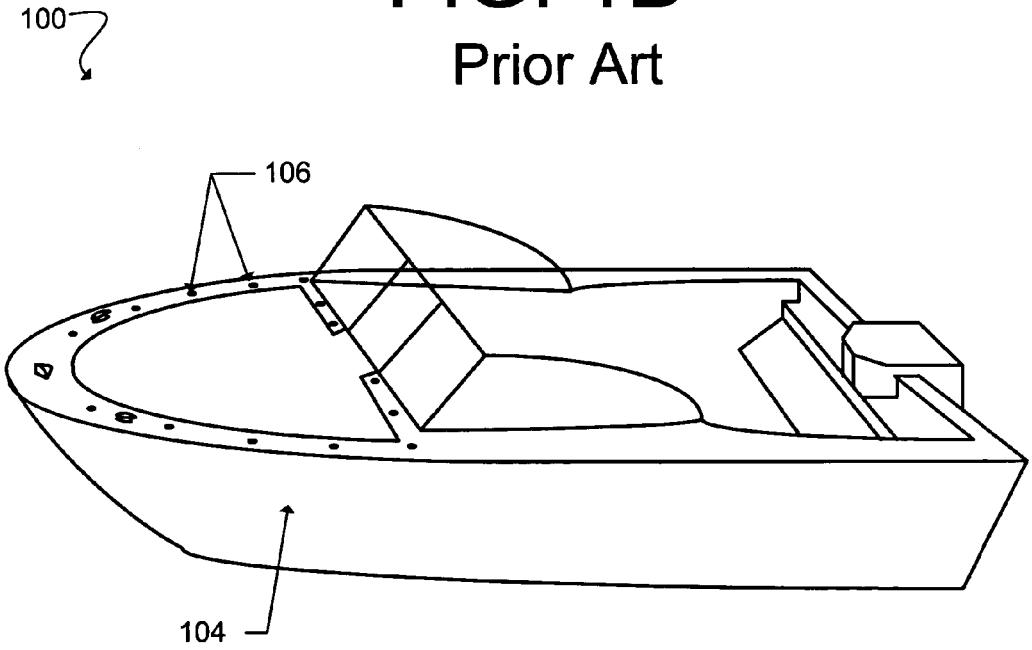
FIG. 1B Prior Art
FIG. 1B is a perspective view of a boat without the boat cover.
Figure 2:
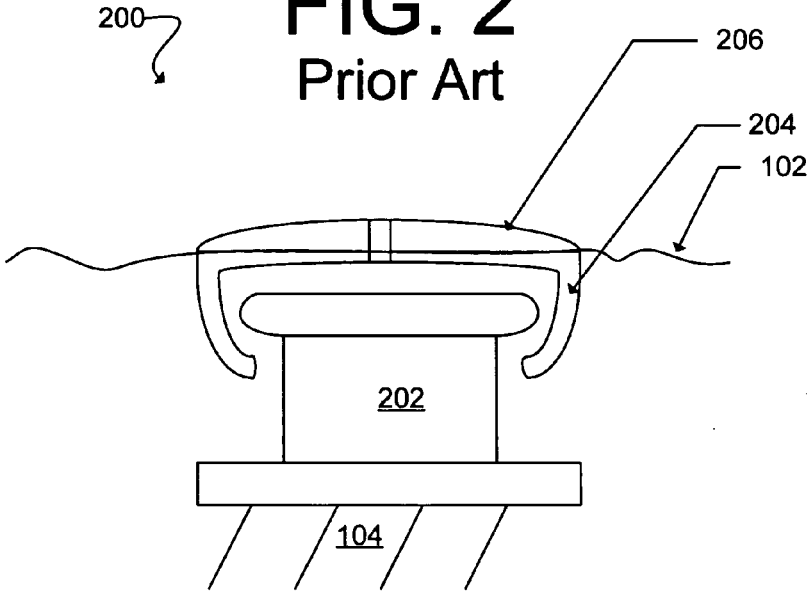
FIG. 2 Prior Art
FIG. 2 is a side elevation view of a snap fastener.
Figure 3A:
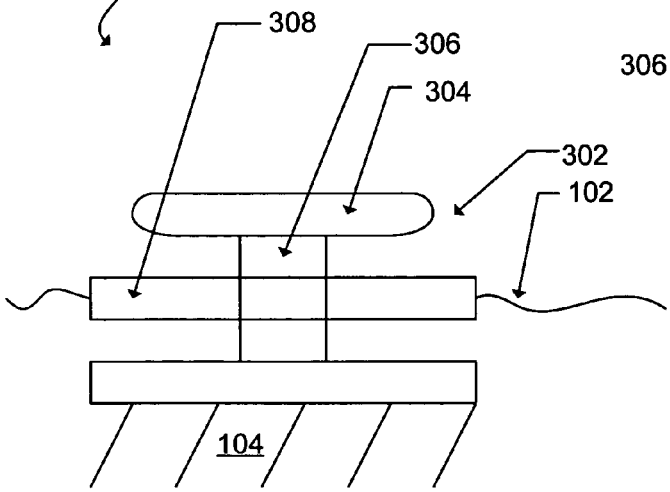
FIG. 3A Prior Art
FIG. 3A is a side elevation view of an eyelet fastener.
Figure 3B:
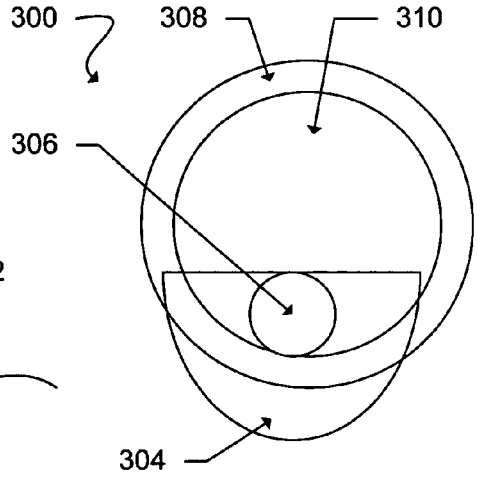
FIG. 3B Prior Art
FIG. 3B is a top planar view of the eyelet fastener.

Referring to FIGS. 4A, 4B, 4C, and 4D, the present invention provides a fastener cover 402 that may be coupled to studs 202, 302 located on a boat 100 when a boat cover 102 is not fastened to the studs 202, 302. The fastener cover 402 protects individuals, such as passengers, that are near or on the boat from contacting the studs 202, 302. The present disclosure provides the fastener cover 402 coupled to the studs 202, 302 on the hull 104 of the boat 100. It should be noted, however, that the studs 202, 302 may be located at different locations on the boat. The fastener cover 402 provides a padded surface to protect boat passengers from contact with the studs 202, 302. Specifically, the padded surface of the fastener cover 402 provides a surface that passengers can rest against without being scratched or poked by the studs 202, 302.

It should be noted that while the present description provides for use of the fastener cover 402 on a boat, the fastener cover 402 may be used on other vehicles or objects where a stud 202, 302 is left exposed after removal of a cover.

Figure 4A:
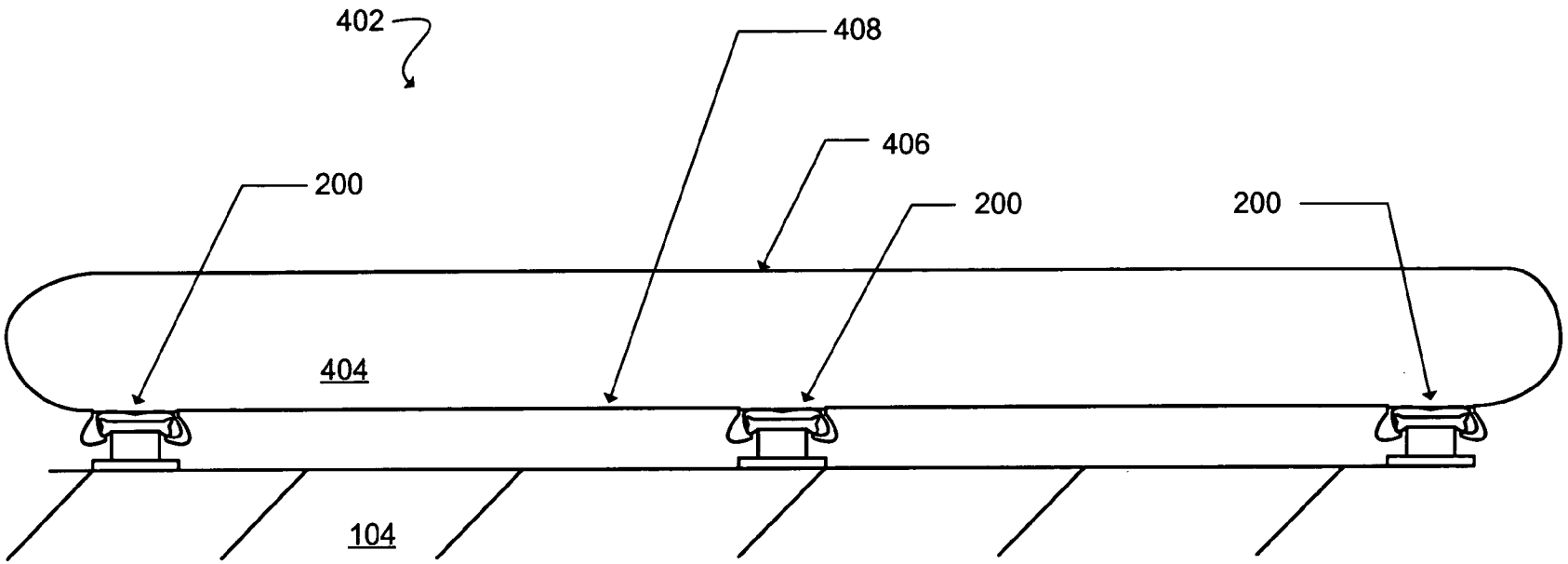
FIG. 4A is a side elevation view of a fastener cover utilizing snap fasteners.
Figure 4B:
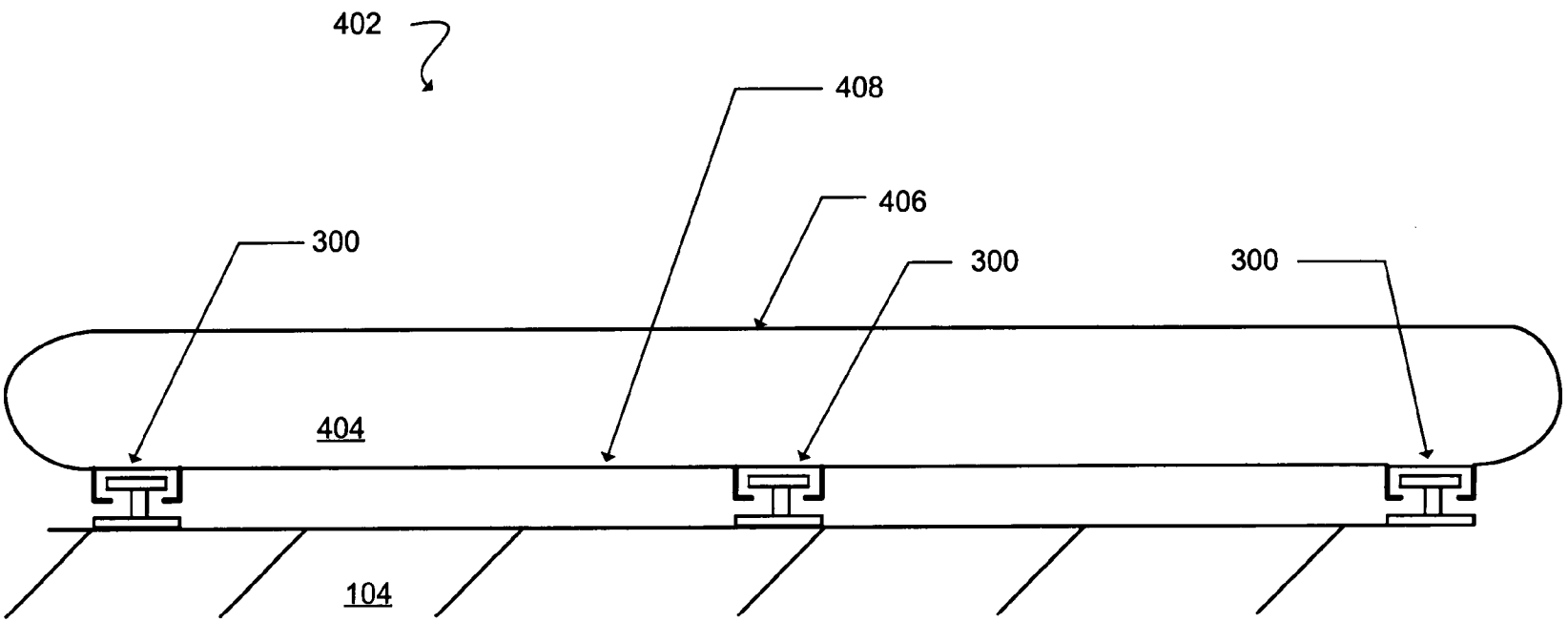
FIG. 4B is a side elevation view of a fastener cover utilizing eyelet fasteners.
Figure 4C:
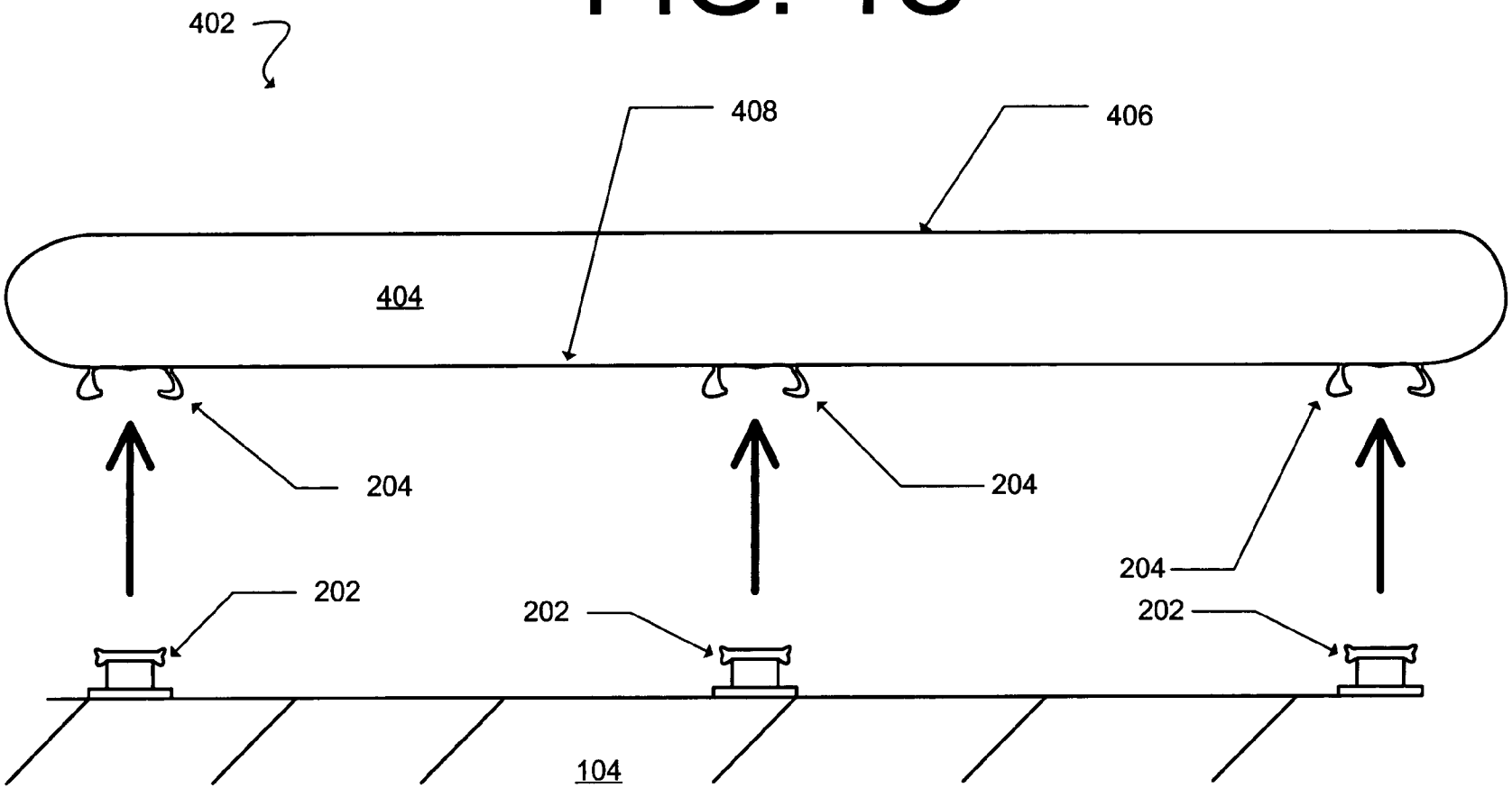
FIG. 4C is a side elevation view of the fastener cover utilizing snap fasteners uncoupled from studs.

FIG. 4A is a side elevation view of the fastener cover 402 coupled to studs 202 and FIG. 4C is a side elevation view of the fastener cover 402 uncoupled from the studs 202. Referring to FIG. 4A and FIG. 4C, the fastener cover 402 has a padded portion 404 coupled to one or more sockets 204. The sockets 204 are sized to couple to the studs 202 on the hull 104 of the boat 100. The padded portion 404, according to a first exemplary embodiment, is made of a semi-rigid foam, rubber, or other material. The padded portion 404 has a top surface 406 and a bottom surface 408. The top surface 406 provides a smooth, soft surface for contact with passengers of the boat 100. As an example, the top surface 406 may be fabricated from weather treated leather, vinyl, or plastic. An edge of the padded portion 404 can be rounded to prevent ropes and clothing from catching to the padded portion 404. The bottom surface 408 has one or more sockets 204 coupled to the bottom surface 408 for allowing a stud 202 to fit therein.

The sockets 204 can be coupled to the bottom surface 408 of the padded portion 404 by using a variety of methods. For example, the sockets 204 can be riveted to the bottom surface 408. The sockets 204 can also be coupled to the bottom surface 408 with glue or an adhesive. In addition, a cap (not shown) specifically made for the socket 204 can be used to couple the padded portion 404 to the socket 204. The above-described methods of coupling the socket 204 to the padded portion 404 are exemplary. A variety of other methods can be used and are within the scope of the invention.

When the user of the boat 100 is finished using the boat 100, the boat user typically prepares the boat 100 for storage or road travel. During such preparation, the user may remove the fastener cover 402. During removal of the fastener cover 402, the boat user unsnaps the sockets 204 of the fastener cover 402 from the studs 202 on the hull 104 of the boat 100. Specifically, the boat user pulls the sockets 204 away from the studs 202 on the hull 104, thereby unsnapping the fastener cover 402 from the boat 100.

Figure 4D:
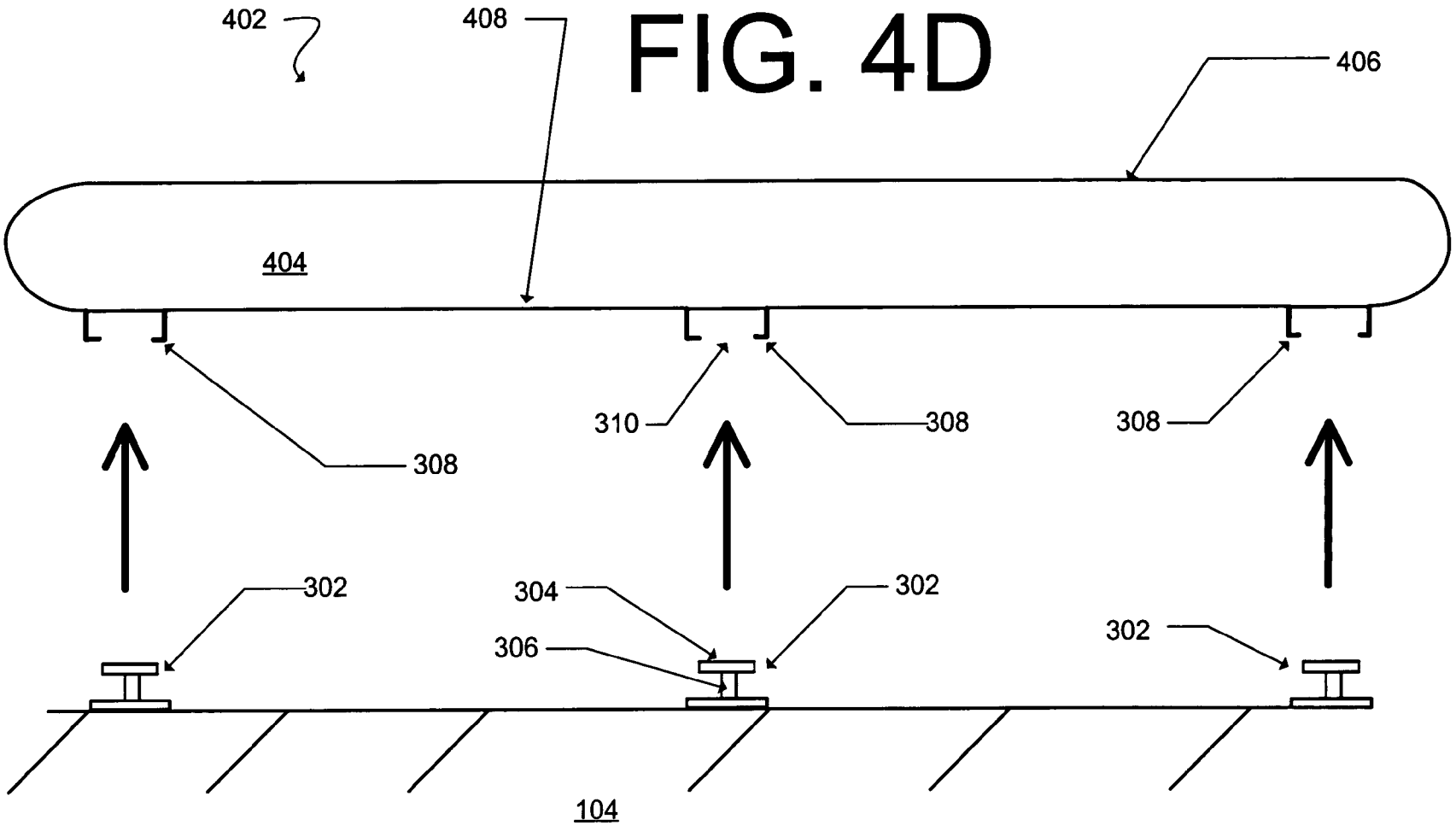
FIG. 4D is a side elevation view of the fastener cover utilizing eyelet fasteners uncoupled from the studs.

The sockets 204 displayed in FIG. 4A and FIG. 4C are snap fastener 200 type sockets 204, however, a variety of other couplings can be used with the fastener covers 402. For example, as is illustrated by FIG. 4B and FIG. 4D, eyelet fasteners 300 can be used with the fastener cover 402 to couple the fastener cover 402 to a hull 104 that uses eyelet fasteners 300 to couple the boat cover 102 to the hull 104 of the boat 100. Referring to FIG. 4D, the eyelets 308 can be coupled to the bottom surface 408 of the padded portion 404 similar to the sockets 204, as discussed above.

If eyelet fasteners 300 are used, as shown in FIG. 4B and FIG. 4D, the boat user positions the eyelet opening 310 to fit over the head 304 of the studs 302 on the hull 104. Once the fastener covers 402 are removed from the hull 104, the fastener covers 402 can be stored for later use. The boat cover 102 can then be installed on the boat 100 by coupling the eyelets 308 on the boat cover 102 to the studs 302 on the hull 104 of the boat 100.

The fastener cover 402 is not limited to using snap fasteners 200 or eyelet fasteners 300. A variety of different types of fasteners 106 can be used to couple the fastener cover 402, each of which is within the scope of the invention.

Figure 5:
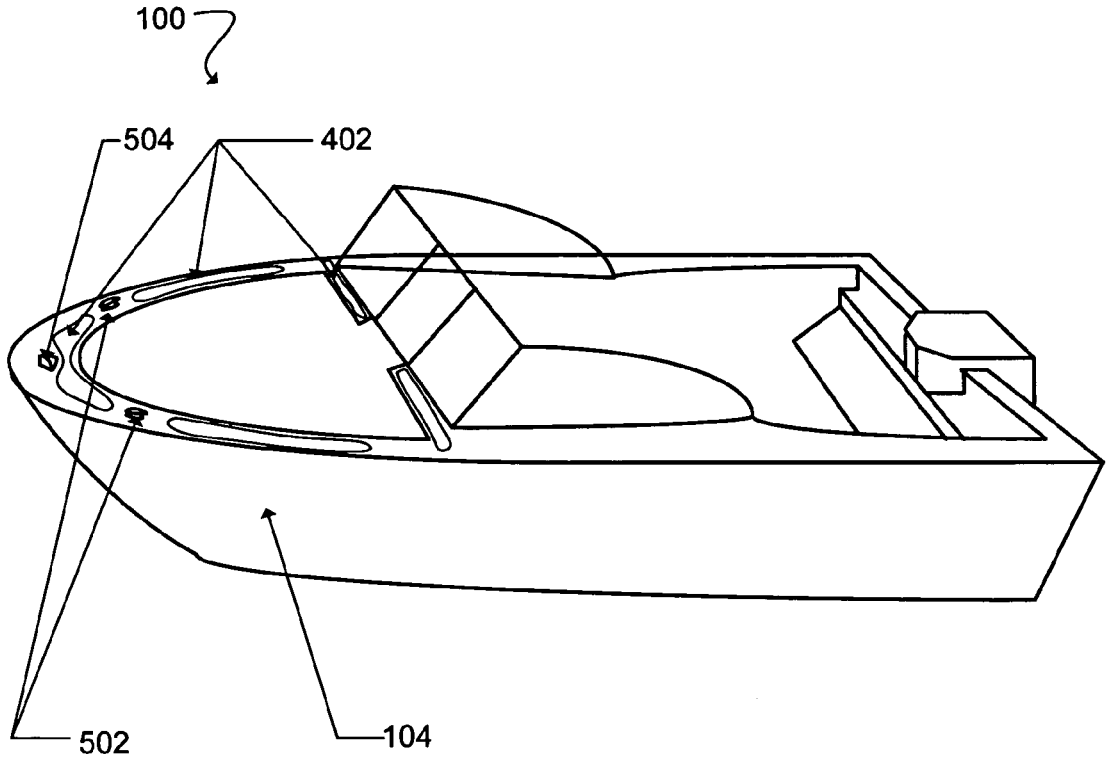
FIG. 5 is a perspective view of a boat with the fastener covers installed.

FIG. 5 is a perspective view of the boat 100 with the fastener covers 402 installed on the hull 104 of the boat 100. The fastener covers 402 can be constructed in a variety of shapes. The fastener covers 402, as shown in FIG. 5, have a rounded top profile, however, the fastener covers 402 can have a variety of profiles. For example, the fastener covers 402 can have a rectangular profile. The fastener cover 402 can be used to couple to one stud 202, 302 or multiple studs 202, 302 on the hull 104 of the boat 100.

The fastener cover 402 can also be designed to have a variety of shapes that do not obstruct access to a variety of other equipment attached to the hull 104 of the boat 100. For example, the fastener cover 402 can be designed to allow access to cleats 502 or deck hand rails (not shown) on the hull 104 of the boat 100. The fastener covers 402 can also be designed to allow visibility of marine travel lights 504. The fastener cover 402 can be shaped to provide an aesthetically pleasing look for the boat 100. In addition, a single fastener cover 402 may be provided that is capable of coupling to all studs 202, 302 on the boat 100. In such an embodiment, the fastener cover 402 may be elongated and have a shape similar to that of a semi-circle, or, if studs 202, 302 are located around the entire boat, the fastener cover 402 may be elongated and have a shape similar to that of an oval.

The shape of the fastener covers 402 is not limited to the shapes discussed above. A variety of fastener cover 402 shapes can be used and are within the scope of the invention. The fastener covers 402 are also not limited to being located in the bow of the boat 100, as shown in FIG. 5. The fastener covers 402 can also be used on studs 202, 302 that may be located on the stern of the boat 100, if a boat cover 102 is capable of attaching to the stern of the boat 100 via rear located studs 202, 302. Such rear located studs 202, 302 are located on the boat 100 for allowing the boat cover 102 to attached to the rear located studs 202, 302 and cover a rear portion of the boat 100.

Figure 6:
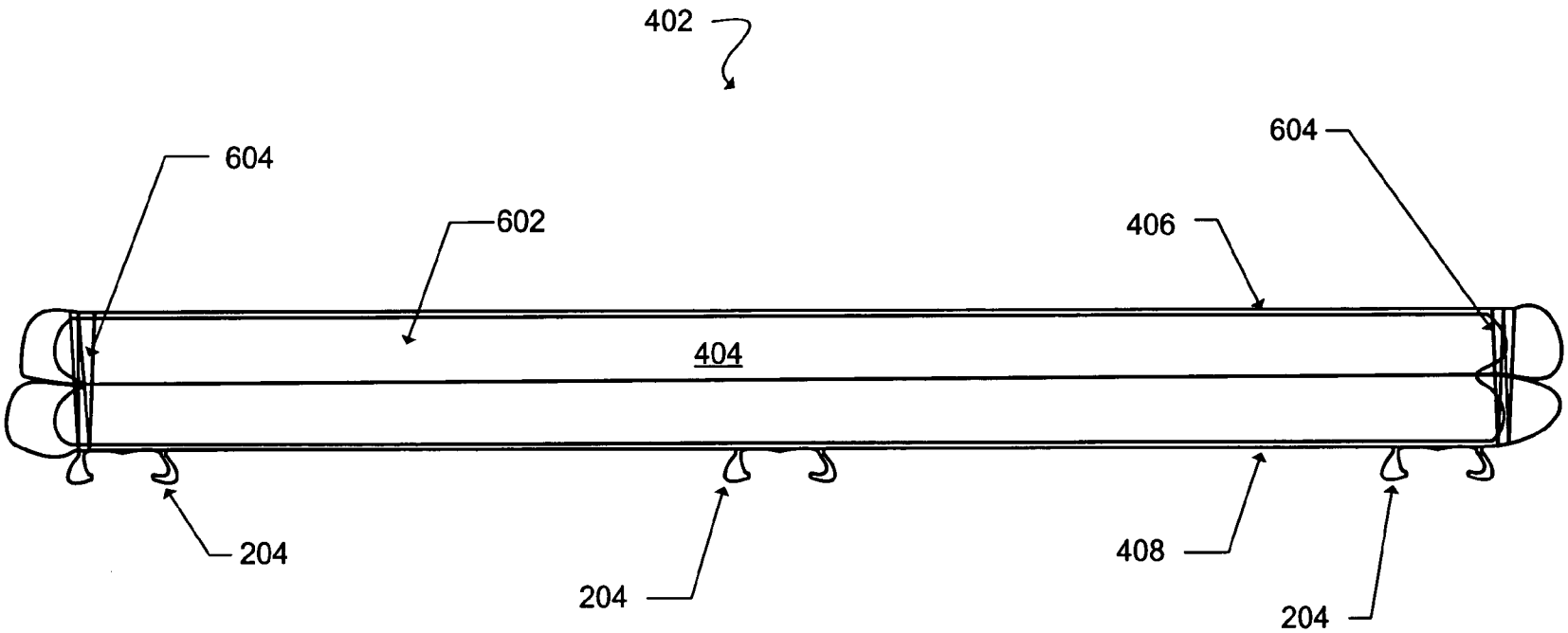
FIG. 6 is a cross sectional view of the fastener cover displaying a second exemplary construction of the padded portion.

FIG. 6 is a cross sectional view of the fastener cover 402 displaying a second exemplary construction of the padded portion 404. According to the second exemplary construction, the fastener cover 402 has a top surface 406 made of a sheet of vinyl, leather, fabric, outdoor carpet, or other material. A bottom surface 408 also is made of a similar sheet of material. Sockets 204, eyelets 308, or other fasteners are coupled to the bottom surface 408 as discussed above. A padding material 602 is sandwiched between the top surface 406 and bottom surface 408. The padding material 602 can be a variety of materials, for example, but not limited to, foam, rubber pad, batting, upholstery filler, or other padded material. The materials of the top surface 406 and bottom surface 408 are coupled together around the perimeter of the fastener cover 402. Stitching 604 can be used to couple the top surface 406 and the bottom surface 408. In addition, staples or other coupling methods can be used couple the material of the top surface 406 and bottom surface 408.

Figure 7:
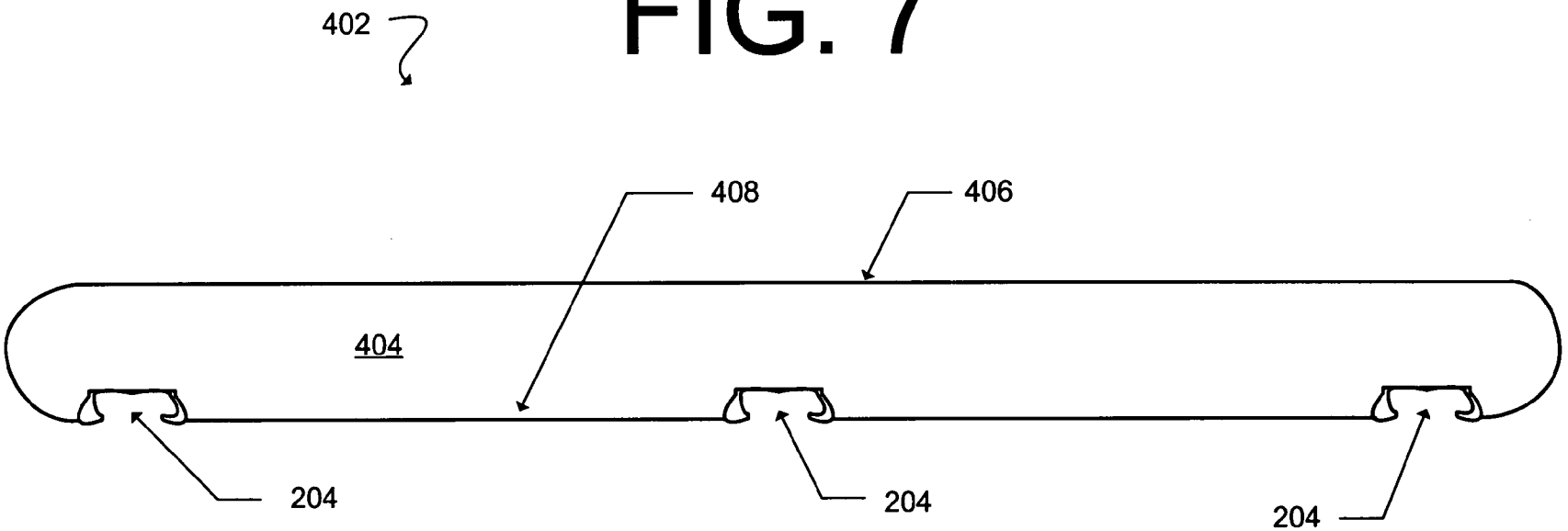
FIG. 7 is a side elevation view of the fastener cover according to a second exemplary embodiment for mounting the fastener cover.

FIG. 7 is a side elevation view of the fastener cover 402 according to a second exemplary embodiment for mounting the fastener cover 402. According to the second exemplary embodiment for mounting the fastener cover 402, the sockets 204 or eyelets 308 (FIG. 7 shows the sockets) can be mounted within the padded portion 404. The second exemplary embodiment for mounting the fastener cover 402 to the padded portion 404 allows the bottom surface 408 of the padded portion 404 to rest snuggly against the hull 104 of the boat 100. The socket 204 or eyelet 308 is not limited to being coupled to the padded portion 404 as discussed above. The socket 204 can be coupled partially within or on the bottom surface 408 of the padded portion 404.

It should be emphasized that the above-described embodiments of the present invention, particularly, are merely possible examples of implementations, merely set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention and protected by the following claims.

What is claimed is:

1. A fastener cover for covering exposed studs on a boat, comprising:

a padded portion having a top surface and a bottom surface, and a padded material located between the top surface and the bottom surface; and a series of sockets that are sized to couple to the exposed studs on the boat, where the sockets are located on the bottom surface of the padded portion, so that when the fastener cover is attached to the exposed studs, the studs are covered by the padded portion, where the series of sockets are connected to the bottom surface of the padded portion.

* * * * *